US008342812B2

(12) United States Patent
Alston

(10) Patent No.: US 8,342,812 B2
(45) Date of Patent: Jan. 1, 2013

(54) VARIABLE SPEED AIR COMPRESSING SYSTEM HAVING AC AND DC POWER SOURCES

(75) Inventor: Gerald Allen Alston, Alameda, CA (US)

(73) Assignee: Crosspoint Solutions, LLC, Indianapolis, IN (US)

( * ) Notice: Subject to any disclaimer, the term of this patent is extended or adjusted under 35 U.S.C. 154(b) by 342 days.

(21) Appl. No.: 12/591,902

(22) Filed: Dec. 3, 2009

(65) Prior Publication Data

US 2010/0143158 A1 Jun. 10, 2010

Related U.S. Application Data

(60) Provisional application No. 61/193,512, filed on Dec. 4, 2008.

(51) Int. Cl.
*F04B 49/00* (2006.01)

(52) U.S. Cl. ..... 417/44.11; 318/108; 307/45; 307/64; 307/72

(58) Field of Classification Search ..... 417/44.11, 417/411; 307/45, 64, 65, 75, 72; 318/107, 318/108

See application file for complete search history.

(56) References Cited

U.S. PATENT DOCUMENTS 5,493,155 A * 2/1996 Okamoto et al. ..... 307/45
5,878,584 A * 3/1999 Sasaki et al. ..... 62/115
5,909,061 A * 6/1999 Sasaki et al. ..... 307/44
6,487,096 B1 * 11/2002 Gilbreth et al. ..... 363/35
6,753,622 B2 * 6/2004 Oughton, Jr. ..... 307/64
7,145,265 B2 * 12/2006 Mc Nulty et al. ..... 307/44
7,227,278 B2 * 6/2007 Realmuto et al. ..... 307/44
7,629,708 B1 * 12/2009 Meyers et al. ..... 307/66
7,701,083 B2 * 4/2010 Savage ..... 307/29
7,714,463 B2 * 5/2010 Su et al. ..... 307/80
8,030,862 B2 * 10/2011 Archer ..... 318/400.01
2003/0048006 A1 * 3/2003 Shelter et al. ..... 307/64
2005/0225090 A1 * 10/2005 Wobben ..... 290/44
2008/0278003 A1 * 11/2008 Pouchet et al. ..... 307/66
2009/0293523 A1 * 12/2009 Bittner et al. ..... 62/236
2012/0025614 A1 * 2/2012 Taimela et al. ..... 307/65
2012/0191252 A1 * 7/2012 Rockenfeller et al. ..... 700/276

* cited by examiner

*Primary Examiner* — Charles Freay
*Assistant Examiner* — Nathan Zollinger
(74) *Attorney, Agent, or Firm* — Krieg DeVault LLP

(57) ABSTRACT

A variable speed air compressing system includes a compressor, a motor configured to actuate the compressor, and a rectifier configured to receive alternating current from a first power source and to provide rectified direct current having a first voltage. The system also includes an inverter configured to receive the rectified direct current and to receive direct current from a second power source having a second voltage. The inverter is configured to provide alternating current to the motor. The alternating current provided to the motor is based on the rectified direct current if the first voltage is greater than the second voltage and the alternating current is based on the direct current from the second power source if the second voltage is greater than the first voltage.

20 Claims, 3 Drawing Sheets

VARIABLE SPEED AIR COMPRESSING SYSTEM HAVING AC AND DC POWER SOURCES

CROSS-REFERENCE TO RELATED PATENT APPLICATIONS

This application claims priority to and the benefit of U.S. Provisional Application No. 61/193,512, filed Dec. 4, 2008, which is herein incorporated by reference in its entirety.

BACKGROUND

The present application relates to a variable speed air compressing system, for example, an industrial variable speed air compressing system.

Industrial air compressors are used in factories and industry to power pneumatic and other devices that require compressed air. Such applications may include hand tools (such as drills or sprays), robotic mechanisms with pneumatic joints, pneumatic lifts, etc.

SUMMARY

In one exemplary embodiment, a variable speed air compressing system includes a compressor, a motor configured to actuate the compressor, and a rectifier configured to receive alternating current from a first power source and to provide rectified direct current having a first voltage. The variable speed air compressing system also includes an inverter configured to receive the rectified direct current and to receive direct current from a second power source having a second voltage. The inverter is further configured to provide alternating current to the motor. The alternating current provided to the motor is based on the rectified direct current if the first voltage is greater than the second voltage and the alternating current is based on the direct current from the second power source if the second voltage is greater than the first voltage.

In another exemplary embodiment, a variable speed drive for an air compressing system includes a rectifier configured to receive alternating current from a first power source and to provide rectified direct current having a first voltage. The variable speed drive also includes an inverter configured to receive the rectified direct current and to receive direct current from a second power source having a second voltage. The inverter is further configured to provide alternating current to a motor. The alternating current provided to the motor is based on the rectified direct current if the first voltage is greater than the second voltage and the alternating current is based on the direct current from the second power source if the second voltage is greater than the first voltage.

In another exemplary embodiment, a variable speed air compressing system, includes a compressor, a motor configured to actuate the compressor, and a rectifier configured to receive alternating current from a first power source and to provide rectified direct current having a first voltage. The system also includes a second power source and an inverter configured to receive the rectified direct current and to receive direct current from a second power source having a second voltage. The inverter is further configured to provide alternating current to the motor. The alternating current is based on the rectified direct current if the first voltage is greater than the second voltage and the alternating current is based on the direct current from the second power source if the second voltage is greater than the first voltage.

It is to be understood that both the foregoing general description and the following detailed description are exemplary and explanatory only, and are not restrictive of the invention as claimed.

BRIEF DESCRIPTION OF THE DRAWINGS

The features, aspects and advantages of the present invention will become apparent from the following description, appended claims, and the accompanying exemplary embodiments shown in the drawings, which are briefly described below.

DETAILED DESCRIPTION

Hereinafter, various exemplary embodiment will be described in detail with reference to the drawings.

Figure 1:
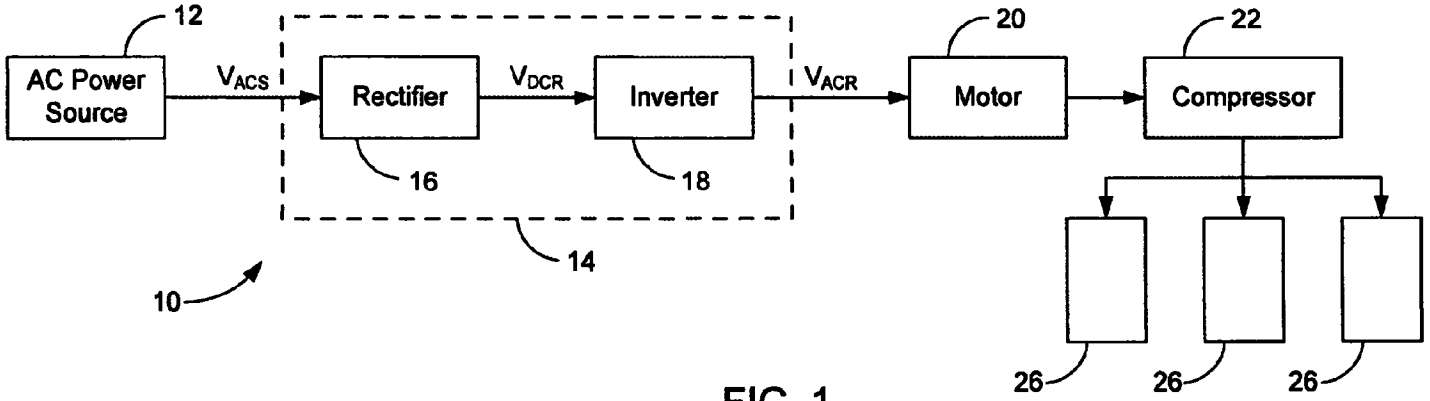
FIG. 1 is a block diagram illustrating a variable speed air compressing system, according to an exemplary embodiment.

FIG. 1 shows a variable speed air compressing system 10, according to an exemplary embodiment. The variable speed air compressing system comprises a variable speed air compressor 22 that uses a variable speed drive 14 to control its speed (RPM). Such a compressor 22 is more energy efficient as compared to a fixed speed air compressor. The variable speed drive 14 for the air compressor 22 is connected to an AC power source 12 providing AC power or voltage $V_{ACS}$. The variable speed drive 14 converts the AC voltage into DC voltage $V_{DCR}$ by rectification using a rectifier 16. The rectified DC voltage $V_{DCR}$ is then converted back into a variable frequency AC voltage $V_{ACR}$ using an inverter 18. The AC voltage $V_{ACR}$ is fed into a motor 22, such as an AC induction motor, which powers the compressor 22. The compressor 22 can be, for example, a 700 hp compressor, which can be used on suitable compressor loads 26, such as hand tools (such as drills or sprays), robotic mechanisms, pneumatic lifts, etc.

Figure 2:
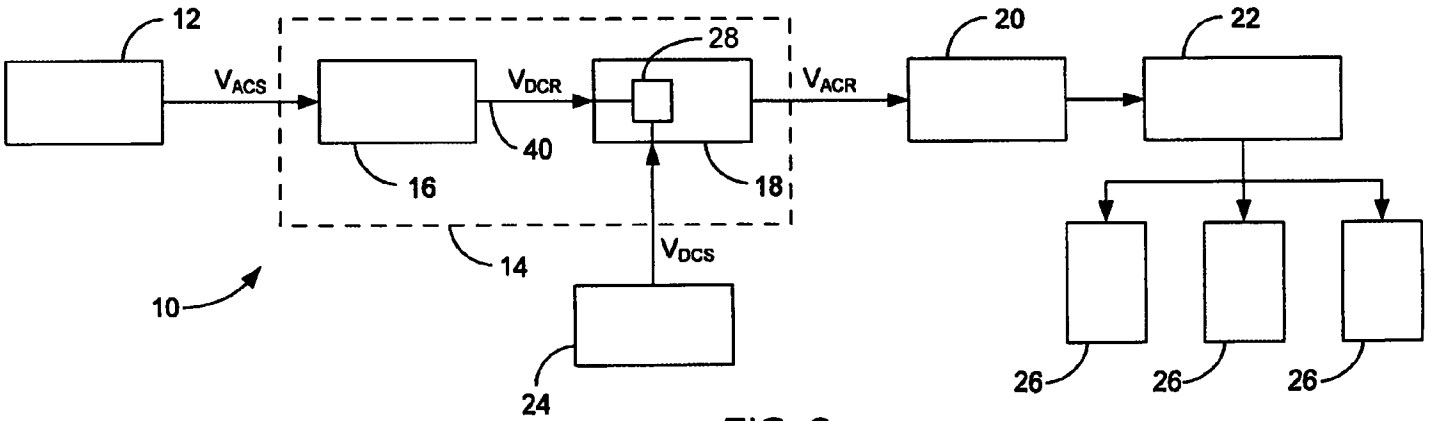
FIG. 2 is a block diagram illustrating a variable speed air compressing system including a power source, according to an exemplary embodiment.

FIG. 2 shows the variable speed air compressing system 10 including a power source 24, according to an exemplary embodiment. The power source may be one or more solar panels, wind power generators, one or more fuel cells, one or more batteries, one or more battery banks, a DC generator, other types of power sources, or any combination thereof. The power source 24 may provide a DC voltage $V_{DCS}$ to the variable speed drive as an additional or alternative source of power to the motor 20.

The power line from the power source 24 may be connected to the variable speed drive by being connected to the power line(s) 40 from the rectifier 16 to the inverter 18, by being connected to the input (DC) bus 28 of the inverter 18, or any other suitable connection.

Figure 3:
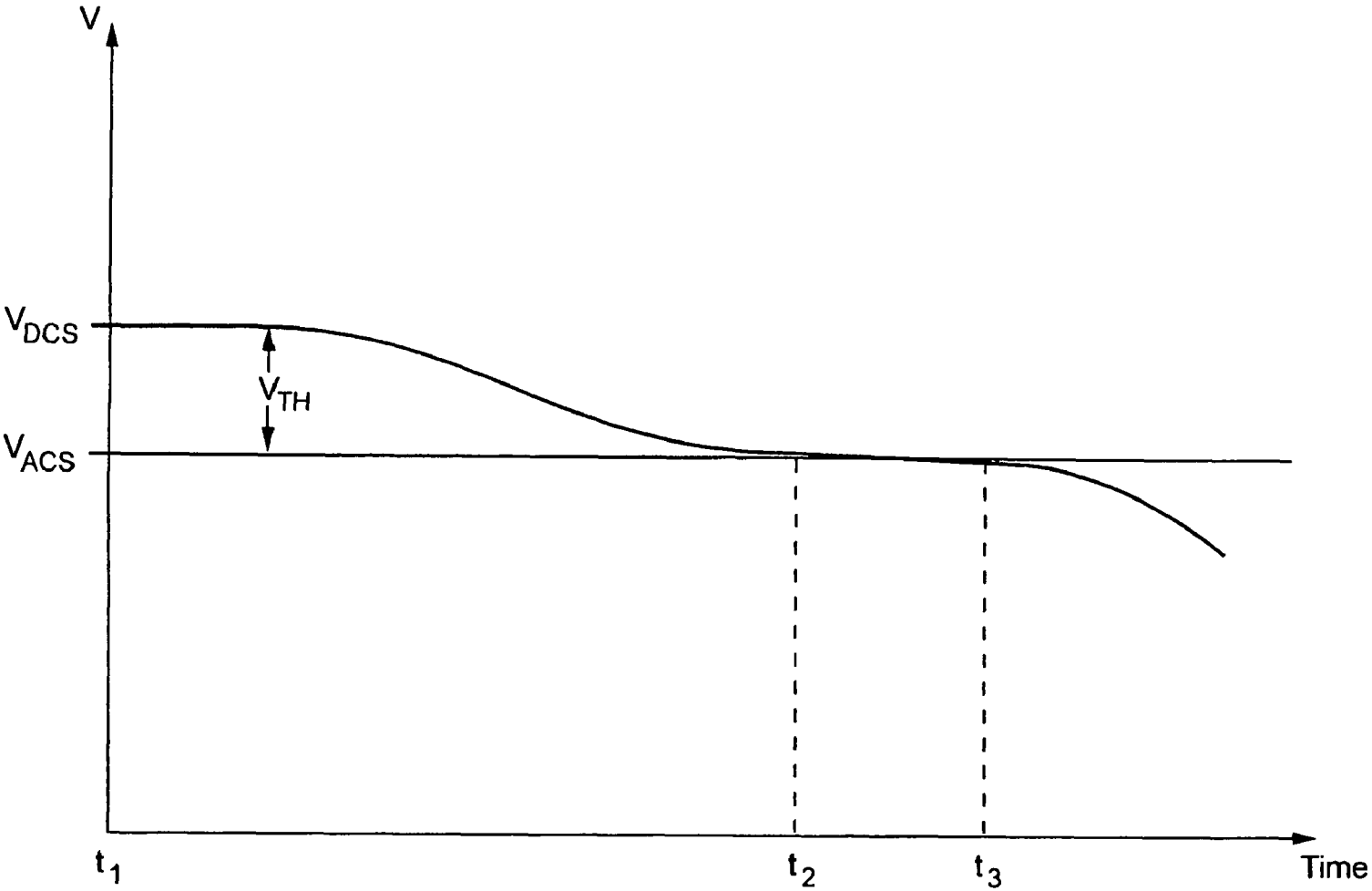
FIG. 3 is a graph illustrating voltage at times during operation of an air compressing system, according to an exemplary embodiment.

According to one exemplary embodiment of the present invention, the power source 24 is the primary power source for the air compressor 22 when the power source 24 provides a voltage Vocs that is greater than the rectified voltage $V_{DCR}$ provided by the rectifier 16. When the motor 22 is being powered by these two different voltages, the motor 22 will draw power from the source with the greater voltage. Thus, the power source 24 is the primary source of power to motor 22 (after the DC voltage being input in the inverter 18 is converted to the variable AC voltage $V_{ACR}$). FIG. 3 shows a graph at times during operation of the air compressing system, according to an exemplary embodiment. Between times $t_1$ and $t_2$, the power source 24 is the primary source of power to motor 22 because $V_{DCS}>V_{DCR}$.

The power source 24 is designed to allow a predetermined amount of allowable "sag" ($V_{TH}$) in the amount of voltage being supplied to the inverter 18 based on the difference in voltages between the rectified voltage $V_{DCR}$ and the voltage from the power source 24 $V_{DCS}$ and the loading down of the power source 24 caused by the motor 20/air compressor 22. For example, if $V_{DCR}$ is designed to provide 550V and $V_{DCS}$ is designed to provide 600V, the power source 24 will provide the primary voltage $V_{DCS}$ to the motor/air compressor (via the inverter 18) because the voltage will be drawn from the higher voltage of 600V. If the loading of the air compressor becomes greater (for example, more devices or systems are added which require more compressed air), the increased loading of the power source 24 causes the available voltage from the power source 24 to drop. If the voltage of the power source 24 drops such that $V_{DCR}$ is substantially equal to $V_{DCS}$ (in this example, $V_{DCS}$ drops until it reaches about 550V), then the motor/air compressor are powered equally by the AC power source 12 and the power source 24. Thus, the power from the AC power source 12 is pulled into the inverter 18 such that the AC power source 12 is used as an auxiliary power source when the voltage of the power source 24 drops below a predetermined threshold (that is, the predetermined amount of voltage sag $V_{TH}$ allowed by the power source 24 is exceeded). In FIG. 3, between times $t_2$ and $t_3$, the power source 24 and the AC power source 12 both supply power equally to the motor 22 because $V_{DCS}$ is substantially equal to $V_{DCR}$.

If the loading of the air compressor becomes even greater (for example, more devices or systems are added which require even more compressed air), the increased loading of the power source 24 causes the available voltage from power source 24 to drop even farther. If the voltage of the power source 24 drops such that $V_{DCR}$ is greater than $V_{DCS}$ (in this example, $V_{DCS}$ drops until it reaches 530V while $V_{DCR}$ remains at 550V), then the motor/air compressor is primarily powered by the AC power source 12 because the higher of the two voltages is utilized. In FIG. 3, after time $t_3$, the AC power source 12 is the primary source of power to the motor 22 because $V_{DCS}<V_{DCR}$.

It should be recognized that the values of the available voltage supplied by the AC power source 12, the maximum voltage available from the power source 24, the power requirements of the air compressor 22, and the predetermined amount of voltage sag $V_{TH}$ allowed by the power source 24 may have any suitable values depending upon the application, requirements, and design of the overall air compressing system. According to one exemplary embodiment, the maximum voltage available from the power source 24 and the predetermined threshold may be fixed after installation of the entire air compressing system is complete. It is also noted that the power source 24 may be configured to be added to an existing air compressing system already existing in a factory or the entire air compressing system may be one stand alone system comprising the motor 20, the variable speed air compressor 22, the variable speed drive 14, the power source 24, and/or any combination thereof.

Figure 4:
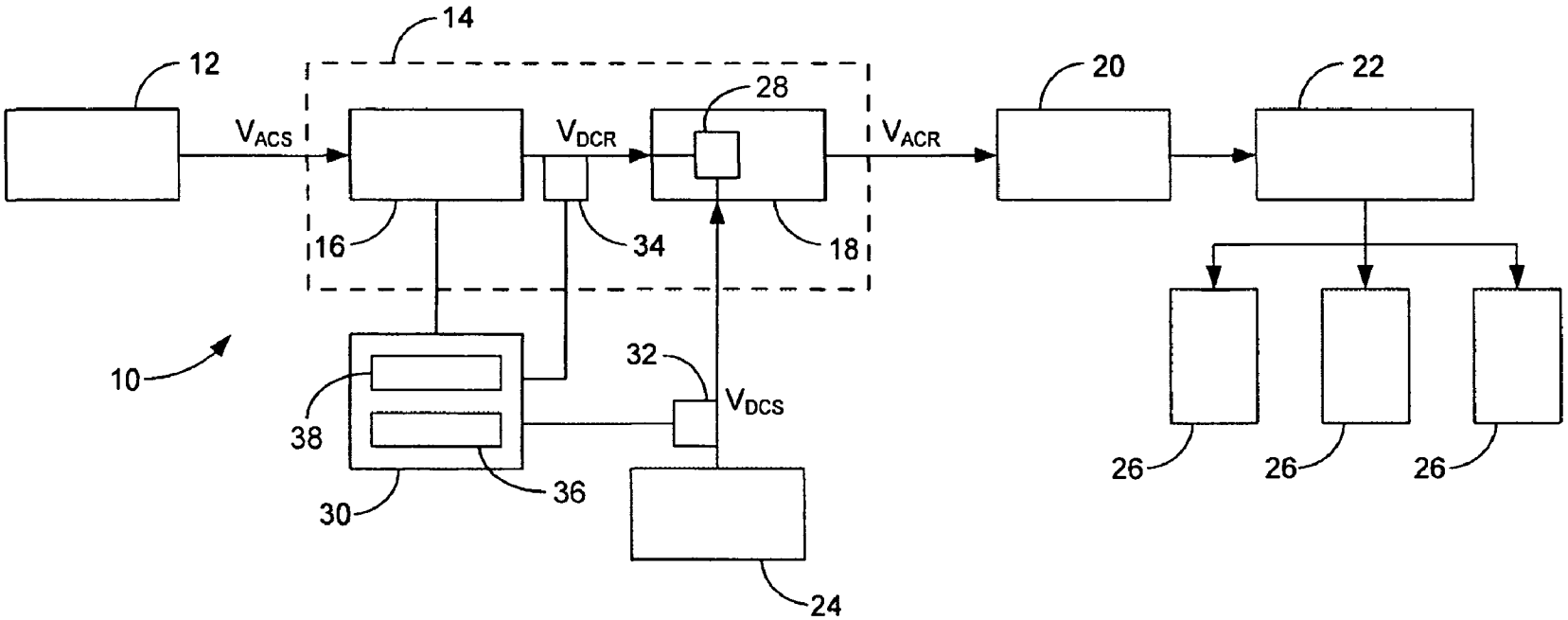
FIG. 4 is a block diagram illustrating a variable speed air compressing system including a power source and a controller, according to an exemplary embodiment.

FIG. 4 shows another exemplary embodiment of the present invention similar to FIG. 2 but also includes a controller 30, according to an exemplary embodiment. The power source 24 is the primary power source for the air compressor 22 when a voltage $V_{DCS}$ is greater than the rectified voltage $V_{DCR}$ provided by the rectifier 16. The power source 24 and the AC power source 12 equally supply power when $V_{DCS}$ is substantially equal to $V_{DCR}$. The AC power source 12 is the primary power source when $V_{DCS}$ is less than $V_{DCR}$. The voltages $V_{DCS}$ and $V_{DCR}$ are read or sensed using voltage sensors 32 and 34, respectively. The sensors 32 and 34 are monitored by the controller 30.

The controller 30 may comprise the necessary hardware, software, or other mechanisms necessary to carry out the functions to which the controller 30 was designed, such as one or more microprocessors, CPU, and/or circuitry. The controller may be configured to change the available voltage from the rectifier such that the available $V_{DCR}$ may be raised or lowered. The effect of changing the voltage $V_{DCR}$ from the rectifier 16 is to make variable the predetermined amount of allowable sag ($V_{TH}$) in the amount of voltage being supplied to the inverter 18 from the power source 24. Thus, the moment in which the power source 24 switches from being the primary source of power to the motor 20 to sharing the load with the AC power source 12 may be changed because the time span that the voltage $V_{DCR}$ is pulled in to share the load with the voltage $V_{DCS}$ may be shortened or lengthened if the voltage $V_{DCR}$ is raised or lowered relative to the voltage $V_{DCS}$, respectively.

According to the exemplary embodiment of FIG. 4, if the controller 30 determines that the amount of allowable sag $V_{TH}$ is to be increased, the controller 30 decreases the amount of available $V_{DCR}$. If the controller 30 determines that the amount of allowable sag $V_{TH}$ is to be decreased, the controller 30 increases the amount of available $V_{DCR}$. The controller may increase or decrease the amount of available voltage $V_{DCR}$ by any known means or mechanism in the art, such as one or more DC-to-DC converters. The controller 30 may increase or decrease the amount of available voltage $V_{DCR}$ based on input from a user using an input device 36, such as a keypad, keyboard, or any other known input device. The controller 30 may also be equipped with one or more displays 38 which output the values of $V_{DCR}$ and $V_{DCS}$. It is also noted that the power source 24 and the controller 30 may be configured to be added to an existing air compressing system already existing in a factory or the entire air compressing system may be one stand alone system comprising the motor 20, the variable speed air compressor 22, the variable speed drive 14, the power source 24, the controller 30, the sensor 32, the sensor 30, and/or any combination thereof.

According to yet another exemplary embodiment of the present invention, the power source 24 may comprise one or more solar panels. The suitable amount of allowable "sag" ($V_{TH}$) for the panels may be determined by using a power point tracking algorithm or PPT to achieve the optimal voltage/operating point for the solar panels. The solar panel may be used as the power source 24 in any of the above exemplary embodiments.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A variable speed air compressing system, comprising:

a compressor;

a motor configured to actuate the compressor;

a rectifier configured to receive alternating current from a first power source and to provide rectified direct current having a first voltage;

an inverter configured to receive the rectified direct current and to receive direct current from a second power source having a second voltage, the inverter further configured to provide alternating current to the motor, wherein the alternating current provided to the motor is based on the rectified direct current if the first voltage is greater than the second voltage and wherein the alternating current provided to the motor is based on the direct current from the second power source if the second voltage is greater than the first voltage; and a controller configured to vary the first voltage to adjust an amount of allowable sag of the second voltage by raising the first voltage to decrease the amount of allowable sag or by lowering the first voltage to increase the amount of allowable sag.

2. The system of claim 1, wherein the inverter is further configured to provide alternating current to the motor based on both of the rectified direct current and the direct current from the second power source if the first and second voltages are equal.

3. The system of claim 1, wherein the controller is configured to monitor the first and second voltages.

4. The system of claim 1, further comprising:

a first voltage sensor configured to read the first voltage; and a second voltage sensor configured to read the second voltage, wherein the controller is configured to monitor the first and second voltages based on the voltage readings of the first and second voltage sensors.

5. The system of claim 3, wherein the compressor is an air compressor configured to selectably drive a plurality of loads.

6. The system of claim 3, wherein the controller further comprises an input device configured to receive user input to raise or lower the first voltage.

7. The system of claim 3, wherein the controller further comprises a display configured to output numeric values of the first and second voltages.

8. A variable speed drive for an air compressing system, comprising:

a rectifier configured to receive alternating current from a first power source and to provide rectified direct current having a first voltage;

an inverter configured to receive the rectified direct current and to receive direct current from a second power source having a second voltage, the inverter further configured to provide alternating current to a motor, wherein the alternating current provided to the motor is based on the rectified direct current if the first voltage is greater than the second voltage and wherein the alternating current provided to the motor is based on the direct current from the second power source if the second voltage is greater than the first voltage; and a controller configured to raise the first voltage to increase the voltage at which the system will transition between the second power source and the first power source and to lower the first voltage to decrease the voltage at which the system will transition between the second power source and the first power source.

9. The variable speed drive of claim 8, wherein the inverter is further configured to provide alternating current to the motor based on both of the rectified direct current and the direct current from the second power source if the first and second voltages are equal.

10. The variable speed drive of claim 8, wherein the controller is configured to monitor the first and second voltages.

11. The variable speed drive of claim 8, further comprising:

a first voltage sensor configured to read the first voltage; and a second voltage sensor configured to read the second voltage, wherein the controller is configured to monitor the first and second voltages based on the voltage readings of the first and second voltage sensors.

12. The variable speed drive of claim 10 wherein the compressor is an air compressor.

13. The variable speed drive of claim 8, wherein the controller further comprises an input device configured to receive user input to raise or lower the first voltage.

14. The variable speed drive of claim 8, wherein the controller further comprises a display configured to output numeric values of the first and second voltages.

15. A variable speed air compressing system, comprising:

a compressor;

a motor configured to actuate the compressor;

a rectifier configured to receive alternating current from a first power source and to provide rectified direct current having a first voltage;

a second power source;

an inverter configured to receive the rectified direct current and to receive direct current from a second power source having a second voltage, the inverter further configured to provide alternating current to the motor, wherein the alternating current provided to the motor is based on the rectified direct current if the first voltage is greater than the second voltage and wherein the alternating current provided to the motor is based on the direct current from the second power source if the second voltage is greater than the first voltage; and a controller configured to control an amount of allowable sag of the second voltage by raising or lowering the first voltage effective to change the point at which power to the motor is switched from the second power source to a combination of the first power source and the second power source.

16. The system of claim 15, wherein the inverter is further configured to provide alternating current to the motor based on both of the rectified direct current and the direct current from the second power source if the first and second voltages are equal.

17. The system of claim 15, further comprising:

a first voltage sensor configured to read the first voltage; and a second voltage sensor configured to read the second voltage, wherein the controller is configured to monitor the first and second voltages based on the voltage readings of the first and second voltage sensors.

18. The system of claim 15, wherein the second power source is connected to a DC input bus of the inverter.

19. The system of claim 15, wherein the controller further comprises an input device configured to receive user input to raise or lower the first voltage.

20. The system of claim 15, wherein the controller further comprises a display configured to output numeric values of the first and second voltages.

* * * * *